United States Patent [19]

Levack

[11] 3,940,817

[45] Mar. 2, 1976

[54] ANTI-CLAMPING SUCTION HEAD FOR SWEEPING SWIMMING POOLS

[76] Inventor: Walter R. Levack, 7900 Chase Ave., Los Angeles, Calif. 90045

[22] Filed: Oct. 18, 1974

[21] Appl. No.: 515,914

[52] U.S. Cl. ..... 15/1.7; 15/415 R

[51] Int. Cl.[2] ..... F04H 3/20

[58] Field of Search ..... 15/1.7, 415

[56] References Cited

UNITED STATES PATENTS

| | | | |
|---|---|---|---|
| 3,243,830 | 4/1966 | Conrad | 15/1.7 |
| 3,273,188 | 9/1966 | Levack | 15/1.7 |
| 3,509,589 | 5/1970 | Bond | 15/1.7 |
| 3,626,535 | 12/1971 | Bond | 15/1.7 |
| 3,805,309 | 4/1974 | Levack | 15/1.7 |

*Primary Examiner*—Edward L. Roberts

*Attorney, Agent, or Firm*—Fulwider, Patton, Rieber, Lee & Utecht

[57] ABSTRACT

A suction head for use in vacuum cleaning a swimming pool bottom intended to avoid clamping of the sweep to the pool bottom. A generally rectangular flexible platform is supported for forward and backward motion perpendicular to the longitudinal axis of the platform while being maintained in spaced parallel relation above the pool bottom. A central opening in the platform is connected to a suction line. Pairs of transverse ribs extending upwardly on the platform are positioned adjacent the opening. A pole for moving the sweep across the pool bottom is pivotally connected to a pillar projecting vertically from the pool sweep adjacent the opening, by a horizontal rigid pin passing transversely through the pillar and through a yoke connected to the adjacent end of the pole. The ends of the pin contact the ribs adjacent the opening and substantially prevent longitudinal flexing of the platform in the region adjacent the opening. By preventing longitudinal flexing in the region adjacent the opening the problem of clamping, i.e. having the underside of the platform moved into contact with the pool bottom, is avoided.

9 Claims, 3 Drawing Figures

ANTI-CLAMPING SUCTION HEAD FOR SWEEPING SWIMMING POOLS

BACKGROUND OF THE INVENTION

This invention relates to a suction head which, when attached to a suction source, may be used for vacuum cleaning the bottom of a swimming pool.

In sweeping the bottom of a swimming pool, it is known to utilize suction cleaning systems comprising a flexible suction line, which communicates with a suction source such as the pool circulation pump, connected to a suction head which distributes the suction over the pool bottom beneath the suction head. Accumulations of dirt on the bottom of the pool, such as particulate material, leaves and the like, which will be collectively referred to hereinafter as "silt," are drawn up the suction line out of the pool for removal. The suction head is usually moved manually across the pool bottom by a handle pivotally attached to the suction head.

Applicant's prior U.S. Pat. No. 3,273,188 discloses such a device made of a flexible plastic material allowing the suction head to conform to curved surfaces on and adjacent to the pool bottom, thereby maintaining a nearly uniform and constant separation between the suction head and the pool surface in these curved regions so that continued effective utilization of the available suction pressure can be achieved. A further advantage of the flexible suction head is that marring or chipping of the plaster surface of the pool is avoided. Another prior pool sweep of a related nature is disclosed in applicant's prior U.S. Pat. No. 3,805,309.

Although these prior devices have performed gratifyingly, a not infrequent problem with suction heads made of flexible material occurs because the plate-like nature of the suction head platform causes it to flex downwardly in the region of greatest suction, namely, the central region of the sweep where the suction line attaches to the platform. The downward flexing in the central region is also contributed to by pressure applied by the operator to the pole to move the pool sweep. This downward flexing may at times be sufficient to bring the underside of the platform into contact with the pool surface, resulting in a phenomenon known as clamping. This clamping, when it occurs, restricts the mobility of the suction head along the pool surface. Clamping can also damage the plaster surface of the pool, the suction source and the suction head. Further, clamping greatly reduces the efficiency of the cleaning operation because the suction source must normally be temporarily deactivated upon each clamping occurrence in order to free the suction head for motion.

The clamping phenomenon is most prevalent in commercial installations, which employ especially strong circulation pumps, and the resulting damage to pools and suction devices, together with the aforementioned inefficiencies mean undesired economic loss for swimming pool maintenance operators. Various approaches have been heretofore available to alleviate the clamping problem.

One approach has been to employ a suction head made of a rigid material, such as those formed primarily of metal which were the most frequently marketed variety less than a decade ago. However, while foreclosing any problems with clamping, the metal suction heads have the disadvantage of not readily conforming to curved surfaces at or near the pool bottom and, furthermore, they have a tendency to chip and mar the plaster surface of the pool. It is desirable to not sacrifice the flexibility of the plastic suction head in solving the clamping problem.

Another approach is to elevate the flexible suction head sufficiently high above the pool surface so that the suction force will be insufficient for clamping to occur. This approach necessarily results in reduced vacuuming efficiency due to the loss of suction force and it is desirable to maintain the suction head in close proximity to the pool surface in order to make most efficient use of the suction pressure.

Thus it is a concern of pool maintenance operators to be able to take advantage of the full suction pressure while utilizing a suction head which is flexible so as to conform to curved surfaces on the pool and which will not tend to damage the plaster surface of the pool.

SUMMARY OF THE INVENTION

A suction head for a swimming pool cleaner, constructed in accordance with the invention, is intended to provide a flexible device which will not sacrifice the advantages of heretofore known flexible pool cleaners, while remaining sufficiently rigid in the area immediately surrounding the opening communicating the suction source to the pool surface as to prevent clamping of the suction head to the pool bottom.

More particularly, a suction head, constructed in accordance with the present invention, includes a generally planar platform composed of a flexible material extending in longitudinal and transverse directions, supported by wheels which maintain the platform spaced above the pool bottom in adjacent, generally parallel relation thereto and facilitate forward and backward motion of the platform perpendicular to its longitudinal axis. An opening extending generally centrally through the platform is adapted for connection to a suction line. The upper surface of the platform is provided with a plurality of parallel longitudinally spaced transverse ribs arranged in pairs. The two ribs closest to the opening on opposite sides of it, constitute two inner ribs. The suction head is moved across the pool bottom by a pole manipulated by an operator standing by the pole. The pool is provided with a yoke at its lower end which loosely embraces a vertical pillar connected to the upper side of the platform adjacent the opening. A horizontal pin extends longitudinally through the pillar and the yoke to connect the pole pivotally to the platform. The pin is rigid and extends beyond the yoke into contact with the adjacent two innermost ribs. The contact between the rigid pin and the two inner ribs substantially prevents longitudinal flexing of the platform in the region adjacent the opening.

By preventing substantial longitudinal flexing in the region adjacent the opening the problem of having the underside of the platform drawn into contact with the pool bottom due to the combined, or separate, effects of the downward component of the force exerted on the pole by the operator and the high suction force beneath the central region of the platform is avoided. As a result, it is possible to utilize a flexible suction head uninhibited by the potential damage and inefficiencies created when the suction head is drawn into contact with the pool surface.

An additional advantage gained by utilizing the pin in the aforementioned manner is that the flexible suction head may be spaced more closely to the pool surface than heretofore possible. Positioning the underside of the platform closer to the pool bottom can result in more efficient utilization of the available suction pressure.

Further, by utilizing the pin it is possible to form the platform of a a more flexible material without fear that the platform will be drawn into contact with the pool bottom by the suction force. Using a more flexible material for the platform will facilitate the sweeping of especially sharp contours in the pool bottom.

A still further consideration is that the suction head, by utilizing the pin, can withstand higher suction forces and thus will be equally usable in home and commercial installations.

BRIEF DESCRIPTION OF THE DRAWINGS

A suction head for sweeping a swimming pool bottom, constructed in accordance with a preferred embodiment of the invention, is illustrated in the accompanying drawings in which.

DETAILED DESCRIPTION

A suction head, according to the present invention, is intended to enable operating the platform at such a relatively short distance from the pool surface as to enable the most efficient use of the suction pressure available without clamping of the platform to the pool surface while still maintaining the desirable characteristics of known prior flexible suction heads.

Figure 1:
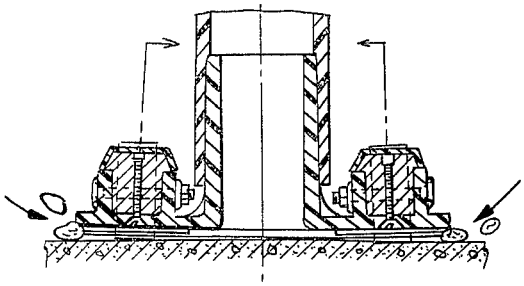
Fig. 1 PRIOR ART
FIG. 1 shows a cross-sectional view of a prior art suction head, illustrating the problem of clamping of the platform in the region of the suction opening.

Flexible suction heads according to the prior art, illustratively shown in FIG. 1, while exhibiting the desirable characteristics of conforming to curved pool surfaces and not marring or chipping plaster surfaces, sometimes tend to clamp to the pool surface in the region of the suction opening due to downward deflection of the platform in its central region either under the influence of the suction alone or due to the combination of the suction and the downward component of force applied to the moving pole by the operator. This problem is especially critical in commercial pool installations where suction pressure is apt to be great and clamping causes inefficiencies resulting in economic loss. The suction head of the present invention is rendered sufficiently inflexible in the region adjacent the suction opening to avoid the clamping phenomemon without sacrificing the advantages of prior flexible suction heads just described.

Figure 2:
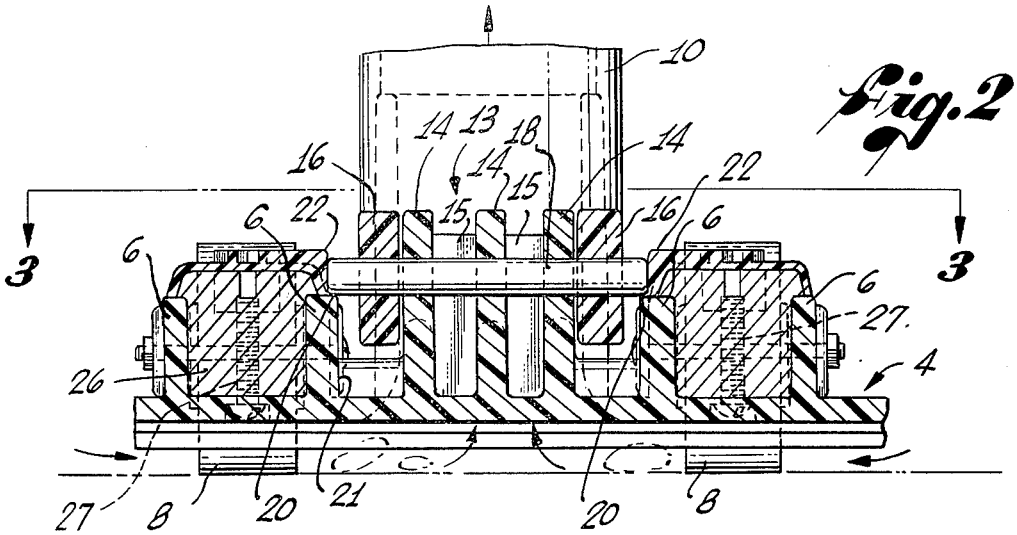
FIG. 2 is a cross-sectional end view of the center portion of a suction head constructed in accordance with the preferred embodiment of the invention.
Figure 3:
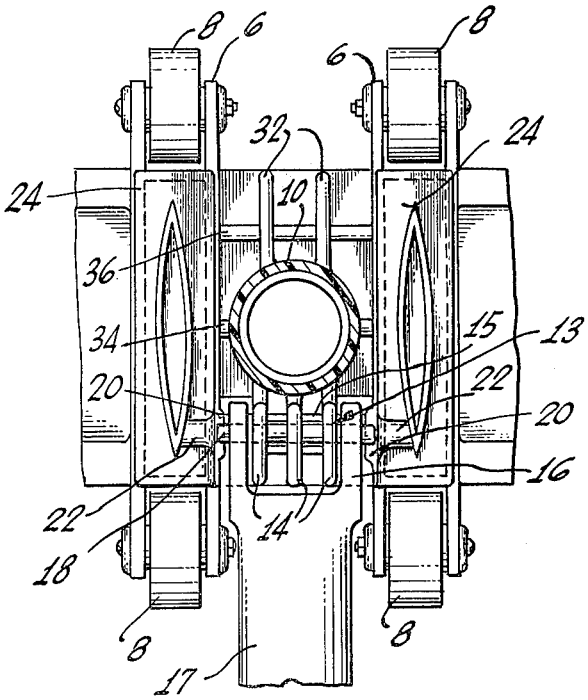
FIG. 3 is a cross-sectional plan view of the center portion of the suction head shown in FIG. 2 taken along the line 3—3 therein.

A suction head (FIG. 2), constructed in accordance with the preferred embodiment of the invention, includes a platform 4 composed of resiliently flexible material, such as plastic, of generally rectangular configuration provided on its upper surface with a plurality of paired, longitudinally spaced, transverse stiffening ribs 6 which extend beyond the edges of the platform to serve as mounts for wheels 8. At approximately the center of the platform there is mounted a suction inlet tube 10 communicating with the underside of the platform 4. The suction inlet pipe is connected via a flexible conduit 12 to a suitable suction source, such as the pump in the circulatory system of the swimming pool, to draw water from the underside of the platform 4 upwardly through the flexible conduit and out of the pool.

Inasmuch as the platform, the transverse ribs, the wheels and the suction inlet opening correspond to structure described in Applicant's prior U.S. Pat. Nos. 3,273,188 and 3,805,309, the descriptions of those patents are incorporated herein by reference.

Of particular interest in the present invention is structure for preventing clamping of the flexible platform to the pool bottom in the region of greatest suction, which is the area immediately adjacent the suction inlet opening 10 on the underside of the platform 4. Such structure includes a vertically extending pillar 13 spaced transversely behind the suction inlet tube 10 and positioned longitudinally between the innermost two of the transverse ribs 6. In the preferred embodiment, the pillar 13 comprises three upright parallel, transversely extending, generally rectangular fingers 14 connected by two spaced, parallel, longitudinally extending webs 15.

Loosely embracing the pillar 13 are the arms 16 of a yoke 17 fixedly secured to the bottom of a pole (not shown) which may be manipulated by an operator standing adjacent the pool. A longitudinally extending, rigid pin 18 mounted horizontally in the pillar 13 extends through the arms 16 of the yoke to provide a pivotal connection between the pole and the suction head. In the preferred embodiment, the pin 18 is formed of a metal resistant to water corrosion, such as stainless steel, and is of sufficient diameter to be substantially inflexible along its length under the loads imposed. The end portions of the pin 18 project over two horizontal, upwardly facing, supporting surfaces 20 provided on each of the two inner ribs 6. In the region of the horizontal surfaces 20, the inner ribs 6 are provided with an inwardly projecting vertically extending thickened portion 21.

If the operator applies an excessive downward component of force on the pole, as may occur when he is maneuvering the suction head adjacent the edge of the pool with the pole nearly vertical, the pin 18 transmits the downward component of force via the inner ribs 6 directly to the wheels 8, rather than applying the force to an unsupported central region of the platform as has been the case with various prior art pool sweeps. As a result, downward deflection of the central region of the platform due to pole pressure, which could combine with the pressure forces resulting from the high degree of suction prevailing on the underside of the platform in the region of the suction inlet opening to cause clamping, is substantially avoided.

The vertical end surfaces of the pin 18 abut two vertical shoulders 22 formed on two weight covers 24. Each weight cover is positioned over a transversely extending, underlying rigid weight 26 which is positioned snugly in each of the channels defined between the ribs 6 in the two rib pairs positioned on either side of the central opening. The weight 26 functions to hold the pool sweep downwardly against the bottom of the pool and, due to its rigid nature, also imparts transverse rigidity to the pool sweep platform across its width while permitting longitudinal flexing of the platform to conform to curved regions adjacent the bottom of the pool. Each weight 26 is fixedly held within the channel defined between the rib 6 and the rib pair by a central threaded member 27 extending upwardly through the bottom of the platform in its central region.

The shoulders 22 function to prevent inward flexing of the inner two of the ribs 6 on opposite sides of the central region, thus preventing the platform from deflecting downwardly in its central region between the two inner ribs into contact with the pool bottom.

From the foregoing description, it will be apparent that a suction head according to the present invention avoids clamping problems associated with prior flexible suction heads by use of the rigid pin 18 in contact with the vertical and horizontal surfaces 20 connected with the two inner ones of the ribs 6. Thus, the downward component of force applied to the pole by which the pool sweep is moved is transmitted directly through the two inner ribs to the wheels 8 and does not cause buckling of an unsupported central region of the pool sweep in the manner known with some prior devices. Additionally, the vertical shoulders 22 on the weight covers assist in preventing inward flexing of the inner two ribs 6, thereby preventing downward deflection of the central region of the platform.

Each of the weight covers 22 is molded to fit over and extend along the top of the associated weight 26 and may be provided with a molded design on its upper surface. The shoulder 22, molded integrally with the weight, includes the previously described vertical surfaces and a hemispherical molded portion extending partially across the top of the weight cover towards its center. On its interior horizontal surface the weight cover is provided with one or more downwardly extending circular projections which are press fitted into undersize holes bored in the upper surface of the weights to secure the weight cover fixedly to the weight. Suitable adhesive may also be utilized.

To further increase the rigidity of the platform in the region between the two inner ones of the ribs 6, two transversely extending stiffening ribs 32, of lesser vertical extent than the ribs 6, are molded on the upper surface of the platform. The stiffening ribs 32 are aligned with the outer two of the walls 14 forming the pillar 13 and extend in opposite transverse directions from the suction inlet tube 10. Additional stiffening in a longitudinal direction is provided by two longitudinally extending stiffening ribs 34 and 36. The longitudinal stiffening rib 34 is aligned with a longitudinal diameter of the inlet tube 10 and extends from it in opposite longitudinal directions into connection with the adjacent inner ribs 6. The other longitudinal stiffening rib 36 is positioned on an opposite side thereof from the pin 18 at an approximately equal spacing from the center of the opening 10 and is connected to the ribs 6 and 32.

As will be appreciated, the construction provided by the transverse stiffening ribs 32 and the longitudinal stiffening ribs 34 and 36, together with the previously described action of the pin 18, renders the platform substantially inflexible in both the longitudinal and transverse directions in the region surrounding the inlet connection. As a result, the platform in this region is substantially incapable of deflection to an extent sufficient to clamp to the bottom of the pool.

Additional pairs of ribs 6, weights 26 and weight covers 24 are provided along the length of the platform to help provide for transverse stiffening of the platform along its entire longitudinal surface. The wheels 8 are secured to the paired ribs 6 through bushings 40 by axles 42. Additional transverse ribs which extend upwardly from the platform and which do not project beyond the platform edges (not shown) are interspersed between the elongated rib pairs as an additional aid in preventing substantial transverse flexing of the platform while permitting longitudinal flexing thereof.

Although the suction head has been described with reference to one preferred embodiment, it will be understood by one skilled in the art that modifications may be made which will still embody the spirit of the invention described and claimed herein.

I claim:

1. A suction head for vacuum cleaning a swimming pool bottom utilizing a suction line connected to a source of suction, wherein the suction head is adapted to be moved across the pool bottom by a pole manipulated by an operator positioned adjacent the pool, the suction head comprising:

a platform composed of material having at least limited flexibility extending in longitudinal and transverse directions;

means supporting said platform for motion while maintaining said platform spaced above the pool bottom in generally parallel relation thereto;

an opening extending upwardly through said platform, said opening on its upper side adapted for connection to the suction line;

at least two vertical, transversely extending inner ribs connected to said platform spaced longitudinally on opposite sides of said opening;

a pillar connected to said platform adjacent said opening projecting upwardly between said inner ribs spaced therefrom;

a yoke adapted to connect the pole to said pillar, said yoke at least partially embracing said pillar; and a rigid pin extending longitudinally through said pillar and through adjacent portions of said yoke said pin connecting the pole to said platform for pivoting motion about a horizontal, longitudinally extending axis, said pin having end portions projecting beyond said yoke in opposite direction into contact with the adjacent said inner ribs to prevent vertical flexing of said platform in the region thereof between said inner ribs to an extent sufficient to prevent adjacent regions of the underside of said platform from deflecting into contact with the pool bottom.

2. A suction head as defined in claim 1 wherein each said inner rib includes, an upwardly facing horizontal surface underlying the adjacent end portions of said pin and abuttingly contacting said end portions to prevent vertical flexure of the region of said platform between said inner ribs into contact with the pool bottom.

3. A suction head as defined in claim 1 further including, two vertical shoulders each fixedly connected to one of said inner ribs in abutting contact with a vertical end surface on the adjacent one of said end portions of pin, said pin resisting relative inward movement of said shoulders and said inner ribs to prevent vertical flexure of the region of said platform between said inner ribs into contact with the pool bottom.

4. A suction head as defined in claim 1 wherein each said inner rib includes, an upwardly facing horizontal surface underlying the adjacent end portions of said pin and abuttingly contacting said end portions to prevent vertical flexure of the region of said platform between said inner ribs into contact with the pool bottom; and a vertical shoulder fixedly connected to said inner rib in abutting contact with an adjacent vertical end surface on the adjacent one of said end portions of pin, said pin resisting relative inward movement of said shoulders and said inner ribs to assist said horizontal surfaces in preventing vertical flexure of the region of said platform between said inner ribs into contact with the pool bottom.

5. A suction head as defined in claim 1 wherein said pillar extends longitudinally between and is spaced longitudinally from said inner ribs, said yoke including two longitudinally spaced parallel arms extending loosely between said pillar and said inner ribs on opposite side of said pillar, said pin extending pivotally through said arms and projecting in overlying relation above said inner ribs.

6. A suction head as defined in claim 5 further including, a vertical suction inlet tube fixedly connected to said platform extending peripherally around said opening at least one transverse stiffening rib connected to said platform extending from said suction inlet tube in opposite transverse directions; and at least one longitudinal stiffening rib connected to said platform on an opposite side of said opening from said pillar extending between said ribs, said stiffening ribs imparting additional rigidity to the region of said platform between said inner ribs.

7. A suction head as defined in claim 3 further including, two transversely extending outer ribs fixedly connected to said platform disposed in longitudinally spaced parallel relation to said inner ribs on opposite sides thereof from said opening, two transversely extending rigid weights each fixedly mounted snugly in the spaces between the adjacent said inner and outer ribs; and two weight covers each extending above and fixedly secured to the adjacent one of said weights, said vertical shoulders being provided on said weight covers.

8. In a suction apparatus for vacuum cleaning a swimming pool bottom utilizing a suction line connected to a source of suction, the suction apparatus including a platform composed of flexible material extending in longitudinal and transverse directions; means supporting said platform for motion while maintaining said platform spaced above the pool bottom in generally parallel relation thereto; an opening extending upwardly through said platform, said opening on its upper side adapted for connection to the suction line; and means for restriction of transversal flexing of the platform; the improvement comprising, a pole adapted to be manipulated by an operator positioned adjacent the pool, at least two vertical, transversely extending inner ribs connected to said platform spaced longitudinally on opposite sides of said opening, a pillar connected to said platform adjacent said opening projecting upwardly between said inner ribs, a yoke fixedly connected to the pole, said yoke at least partially embracing said pillar, and a rigid pin extending longitudinally through said pillar and through adjacent portions of said yoke, said pin connecting the pole to said platform for pivoting motion about a horizontal, longitudinally extending axis, said pin having end portions projecting beyond said yoke in opposite directions into contact with the adjacent said inner ribs to prevent vertical flexing of said platform in the region thereof between said inner ribs to an extent sufficient to prevent adjacent regions of the underside of said platform from deflecting into contact with the pool bottom.

9. A suction head for vacuum cleaning a swimming pool bottom utilizing a suction line connected to a source of suction, the suction head comprising:

a platform composed of material having at least limited flexibility extending in longitudinal and transverse directions;

a plurality of upward extending elongated transverse ribs molded with said platform on its upperside, said ribs grouped in pairs, said ribs extending beyond the longitudinal edges of said platform;

front and rear wheels mounted in said elongated transverse rib pairs, said wheels rotatably mounted between the portions of said rib pairs extending beyond the longitudinal edges of said platform;

an opening extending upwardly through said platform, said opening on its upper side having a connection to the suction line;

a plurality of transversely extending spaced parallel rigid weights each mounted in one of said elongated rib pairs, a plurality of cover members each covering the upperside of one of said weights, the two of said cover members positioned most nearly adjacent said opening on either side thereof having, a pair of spaced inwardly facing, transversely aligned abutments positioned thereon, a horizontal pin composed of rigid material, said pin extending transversely between said abutments in abutment therewith at its opposite ends, said pin adjacent its ends having its lower surface overlying the upper surfaces of the two innermost ones of said ribs, said pin contacting said innermost ribs and said shoulders to prevent longitudinal flexing of said platform in the region of said inlet opening, at least one upwardly-extending pillar connected with said platform, said pin extending through said pillar to be supported thereby; and a pole pivotally connected with said pin for moving said platform across the pool bottom.

* * * * *